US006053482A

United States Patent [19]

Glenn et al.

[11] Patent Number: 6,053,482

[45] Date of Patent: Apr. 25, 2000

[54] HUMIDIFIER INCLUDING A WATER FILTRATION DEVICE

[75] Inventors: Neville R. Glenn; Robert VannRox, both of Milford, Mass.

[73] Assignee: Holmes Products Corp., Milford, Mass.

[21] Appl. No.: 09/016,503

[22] Filed: Jan. 30, 1998

Related U.S. Application Data

[60] Provisional application No. 60/036,635, Jan. 31, 1997, abandoned.

[51] Int. Cl.[7] ..... B01F 3/04

[52] U.S. Cl. ..... 261/4; 261/66; 261/99; 261/104; 261/141; 261/DIG. 46

[58] Field of Search ..... 261/4, 38, 66, 261/99, 141, 104, 107, DIG. 41, DIG. 46, DIG. 65

[56] References Cited

U.S. PATENT DOCUMENTS

| | | | |
|---|---|---|---|
| 3,917,759 | 11/1975 | Martin . | |
| 4,257,989 | 3/1981 | Nishikawa | 261/4 |
| 4,306,971 | 12/1981 | Hankammer . | |
| 4,339,307 | 7/1982 | Ellis, Jr. . | |
| 4,604,246 | 8/1986 | Choe . | |
| 4,623,457 | 11/1986 | Hankammer . | |
| 4,631,152 | 12/1986 | Uchida et al. | 261/4 |
| 4,663,091 | 5/1987 | Seo | 261/DIG. 46 |
| 4,666,600 | 5/1987 | Hankammer . | |
| 4,724,104 | 2/1988 | Kim | 261/4 |
| 4,839,014 | 6/1989 | Park et al. . | |
| 4,895,648 | 1/1990 | Hankammer . | |
| 4,969,996 | 11/1990 | Hankammer . | |
| 5,354,515 | 10/1994 | Ushimaru | 261/DIG. 46 |
| 5,407,604 | 4/1995 | Luffman | 261/4 |
| 5,524,848 | 6/1996 | Ellsworth . | |
| 5,783,117 | 7/1998 | Byassee et al. | 261/DIG. 46 |

FOREIGN PATENT DOCUMENTS

| | | | |
|---|---|---|---|
| 61-272540 | 12/1986 | Japan | 261/4 |
| 61-282740 | 12/1986 | Japan | 261/4 |

OTHER PUBLICATIONS

Product Sheet, What is Brita?: Filter Closeup, Brita Products Co., Oakland CA, undated.

Product Brochure, Holmes Cool Mist Humidifier, HM–1730, Holmes Products Corp., Milford, MA, 1995.

Product Brochure, Holmes Cool Mist Humidifier, HM–1750, Holmes Products Corp., Milford, MA, undated.

Product Brochure, Holmes Visible Mist Humidifier, HM–460B, Holmes Products Corp., Milford, MA, 1994.

Product Brochure, Holmes Humidifier Accessories, Holmes Products Corp., Milford, MA, undated.

*Primary Examiner*—C. Scott Bushey

*Attorney, Agent, or Firm*—Hoffman & Baron, LLP; Francis E. Marino

[57] ABSTRACT

A humidifier for vaporizing water including a base and a wick formed of a water absorbing material positionable on the base. The wick is in fluid communication with a water supply. A device is provided for moving air over the wick disposed adjacent thereto to vaporize the water absorbed by the wick thereby humidifying the air about the humidifier. A filtration device disposed in the flow of the water to the wick is provided and the filtration device is capable of removing impurities from the water supplied to the wick such that the wick is not contaminated by the impurities.

28 Claims, 10 Drawing Sheets

HUMIDIFIER INCLUDING A WATER FILTRATION DEVICE

This application claims priority to provisional application No. 60/036,635 filed under 35 USC 119(e) on Jan. 31, 1997, now abandoned.

FIELD OF THE INVENTION

The present invention relates to a humidifier. More particularly, the present invention relates to a humidifier having a filtration device which filters the water supply prior to vaporization. The filtration device is preferably designed to remove impurities such as minerals, lead, chlorine and organic compounds from the water so that these contaminants are not expelled into the environment or negatively affect the humidifier.

BACKGROUND OF THE INVENTION

In general, humidifiers vaporize water and expel the vapor into the surrounding environment in order to increase the moisture content thereof. Such increased humidity may be desirable in order to improve the comfort level for individuals experiencing the humidified air. For example, during cold weather indoor humidity levels can drop causing drying of skin or throat and adding to the discomfort of respiratory infections. While humidifiers may be used in a variety of circumstances, they are especially useful in maintaining a comfortable humidity level in otherwise low humidity conditions. Humidifiers are available in a variety of sizes and designs and include both console units and portable units. Console units typically are large stationary units having the humidifying capacity to affect large areas such as an entire house. Portable units are smaller in size and usually have the humidifying capacity to meet the requirements of a single room. Portable humidifiers due to their small size permit them to be moved from room to room as required. In addition, portable humidifiers utilize various means of producing the water vapor including heating coils, ultrasonic transducers and evaporative wicks.

Conventional construction of a portable humidifier includes a base unit containing a water reservoir in which the water is held just prior to vaporization by a humidification device. Water is supplied to the reservoir by a supply tank which is removably supported in the base. The tank may be removed as required in order to replenish the water supply. Water is typically introduced into the tank through a fill hole which is covered by a removable cap.

Water is typically transferred from the tank to the base reservoir through a valve assembly disposed in the bottom of the tank. When the tank is placed in the base, the valve engages a member on the base which urges the valve into an open position thereby allowing the water to flow into the reservoir. As water flows from the tank to the reservoir, air simultaneously is drawn into the tank through the valve by the vacuum created from the exiting water. When the water level in the reservoir rises to such a degree that the valve opening becomes covered with water, a hydrostatic balance is reached and the flow of water ceases. As water is vaporized, the reservoir level drops disturbing the balance and resulting in the continued flow of water from the tank. This controlled flow cycle ensures that the humidification device will have a supply of water with which to vaporize, as well as limiting the amount of water such that no water spills over the edges of the base reservoir.

The water which is stored in the supply tank is typically obtained from the tap. Such water may be supplied through a municipal water system or through a well located on site. Untreated tap water typically contains various impurities dissolved in and/or carried by flowing water. Common contaminants include salts of calcium and magnesium, metals such as copper and lead which has leached out from the plumbing and sediment type particulate. Water supplies may also be contaminated with volatile organic compounds and trihalomethane. In addition, municipal water supplies are often treated with a chlorine based compound for disinfection purposes in order to neutralize bacteria or other potentially harmful organisms found in the water supply. All of the aforementioned contaminants can hinder the effectiveness of the humidifier and offset the benefits thereof.

The water borne contaminants detrimentally effect each of the various types of humidifiers which are commercially available. Wick type humidifiers rely on a cellulose composed wick to absorb water through a capillary action. The water is then evaporated from the wick by a forced stream of air directed over the wick. Upon evaporation of the water most of the contaminants precipitate out and remain on the wick. However, after a period of time the precipitates, such as the dissolved minerals and sediment, tend to form at the base of the wick and the wick basin. These precipitates tend to clog the wick thereby reducing its ability to absorb water.

Heat type humidifiers transform water to a vaporized state through the application of heat by way of an electrical resistance coil or disc. The heating chamber from which the water evaporates eventually becomes coated by a with a build up of residue from the minerals, known as scale, and other contaminants contained in the water. This residue may result in an obstruction to the flow of water into the heating chamber and otherwise decrease the efficiency of the humidifier. Therefore, the humidifier must be cleaned frequently to remove the unwanted deposits.

Nebulizing humidifiers which atomize the water typically by way of an ultrasonic transducer expel the water including its contaminants into the air. The contaminants carried by the aerosolized water droplets eventually precipitate out creating a residue which is commonly known as white dust. This dust forms on and around the humidifier resulting in the need for frequent cleaning. Attempts have been made to control this problem by employing a filter between the water supply and the humidification device. Such filters are of the deionization type which remove the ions of the dissolved minerals in the water such as calcium or magnesium. These filters, while eliminating the contaminants which form white dust, they still permit various substances such as chlorine to pass through and enter the air.

Some of the contaminants which are permitted to be vaporized may have harmful side effects on exposed individuals. Wick and heat type humidifiers allow tap water contaminants which are volatile, such as chlorine and organic compounds, to evaporate into the air and become an inhalant. Nebulizing humidifiers atomize chlorine containing water such that it may be inhaled. Several authorities have suggested that evaporated chlorine compounds which are transformed into an inhalant, i.e., either as a gas or nebulized water particles, may cause potentially harmful health effects to exposed individuals.

In addition to the use of wicks and deionizing type filters to remove contaminants from tap water, various attempts have been made to filter humidifier supply water to reduce the amount of contaminants entering the air. One such device is disclosed in U.S. Pat. No. 4,604,264 to Choe. Choe discloses a combination humidifier and water distiller apparatus. The device includes a container for holding tap water and a heater for heating the tap water in the container to a vaporized state. A condenser is positioned above the container and condenses the vaporized water such that the water, now distilled, drops down and is collected. The distilled water is then transported via a water track and valve to a humidification chamber where the water is nebulized and delivered as a fine spray to the atmosphere thereby humidifying the surrounding air. However, the humidifier of Choe while purifying the water does not prevent substances such as chlorine from entering the environment when the water is vaporized. Also, the minerals that precipitate out during the distilling process must be cleaned from the heater. In addition, a device which requires both a distilling heating element and a humidification device would prohibitively expensive to manufacture and successfully market.

Filters which purify tap water by removing minerals and other contaminants such as chlorine are known in the art. However, due to their size they have been difficult to incorporate in the relatively tight size constraints found in a portable humidifier. The size of the filter must be large enough so that its effective filtration life is long enough to make the product commercially viable. Heretofore, the prior art has been unable to produce the humidifier which can accommodate a purification filter which is commercially available.

Accordingly, it would be desirable to provide a humidifier which includes a filtration device capable of removing substantially all contaminants including minerals and chlorine from the water prior to its vaporization. It would also be desirable to provide a humidifier which is economically feasible to produce and is designed to accommodate a commercially available water filtration device.

SUMMARY OF THE INVENTION

It is an object of the present invention to provide a humidifier having a water filtration device.

It is a further object of the present invention to provide a humidifier having a wick formed of a water absorbing material and a device for a for providing a controlled flow of the water to the wick and a device for moving air over the wick to vaporizing the water thereby humidifying the air about the humidifier. The present invention also provides a filtration device disposed in the flow of water to the wick. The filtration device is capable of removing impurities from the water supplied to the wick such that the wick is not exposed to the impurities contained in the water.

In a preferred embodiment the filtration device is capable of filtering a substantial amount of chlorine from the water prior to vaporization thereof, such that the vaporized water will be substantially free of chlorine.

It is a further object of the present invention to provide a humidifier for vaporizing water including a refillable tank for holding a supply of water and a humidification device for vaporizing the water thereby humidifying the air about the humidifier. A device for providing a controlled flow of the water from the tank to the humidification device is further included. A filter is disposed in the flow of water between the tank and the humidification device. The filter reducing an amount of chlorine from the water prior to vaporization thereof, such that the vaporized water will be substantially free of chlorine.

It is still a further object of the invention to provide a humidifier including a tank for holding a water supply and a base unit having a reservoir being in fluid communication with the water supply tank. The reservoir having a bottom portion including an orifice through which water may flow. A humidification device for vaporizing the water to humidify the air is disposed on the base adjacent a basin. A control valve is provided for regulating the flow of water from the tank into the reservoir which permits the water to flow from the tank into the reservoir when a water level in the reservoir drops below a low water level. The base further includes the basin having a bottom wall for holding the water prior to vaporization by the humidification device. The humidifier further including a conduit for fluidly connecting the orifice to the basin. The basin bottom wall being disposed vertically above the orifice and vertically below the low water level such that the basin will have a controlled supply of water from the tank.

It is yet a further object of the invention to provide a method of providing humidified air comprising the steps of providing a device for humidifying air including a wick and providing a filter. Water is supplied to the filter thereby reducing the impurities therein. The filtered water is then transported to the wick and the water is evaporated from the wick thereby humidifying the surrounding air.

DETAILED DESCRIPTION OF THE PREFERRED EMBODIMENT

Figure 1A:
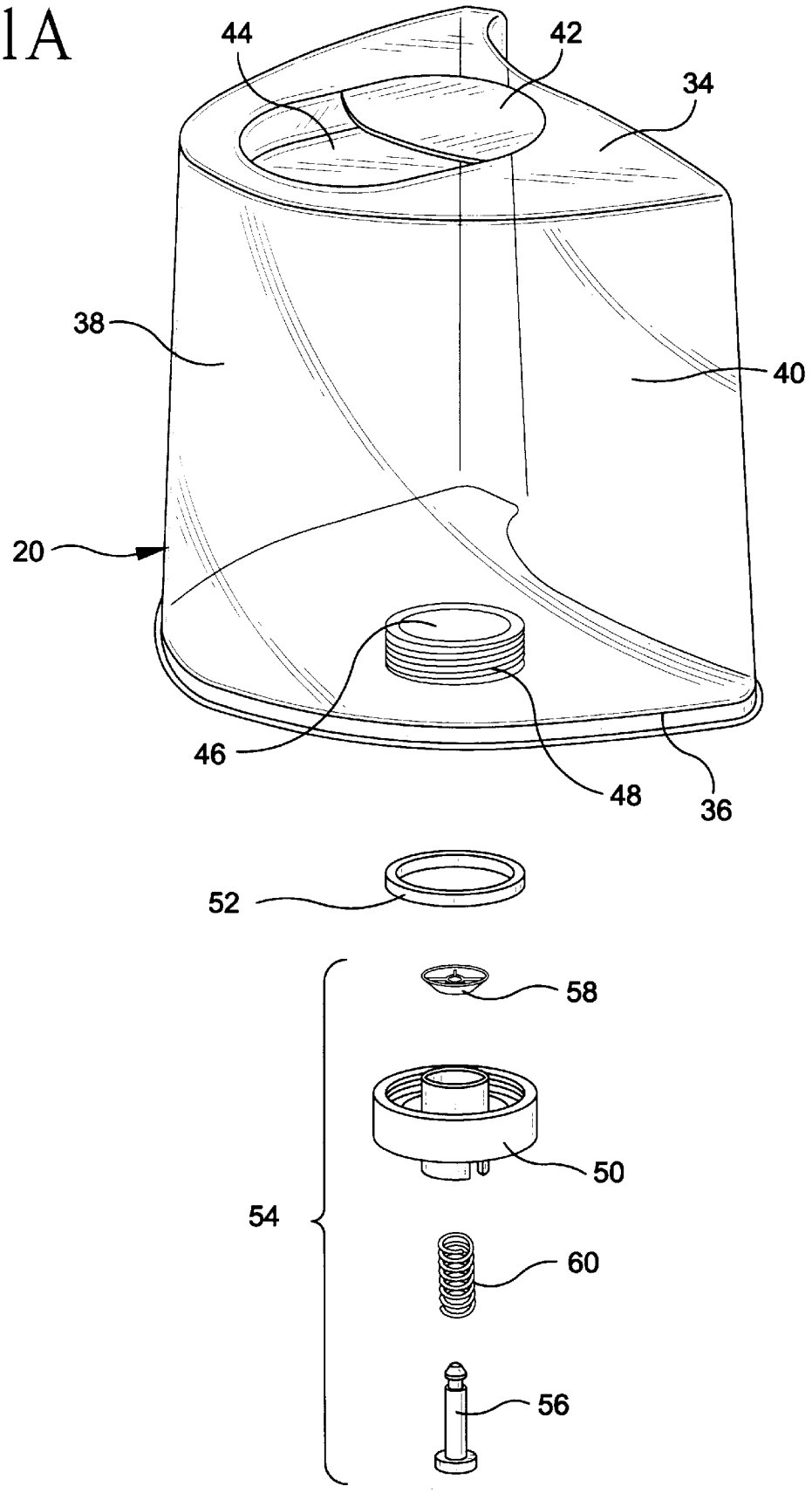
FIG. 1A is an exploded perspective view of the tank and valve assembly of the present invention.
Figure 1B:
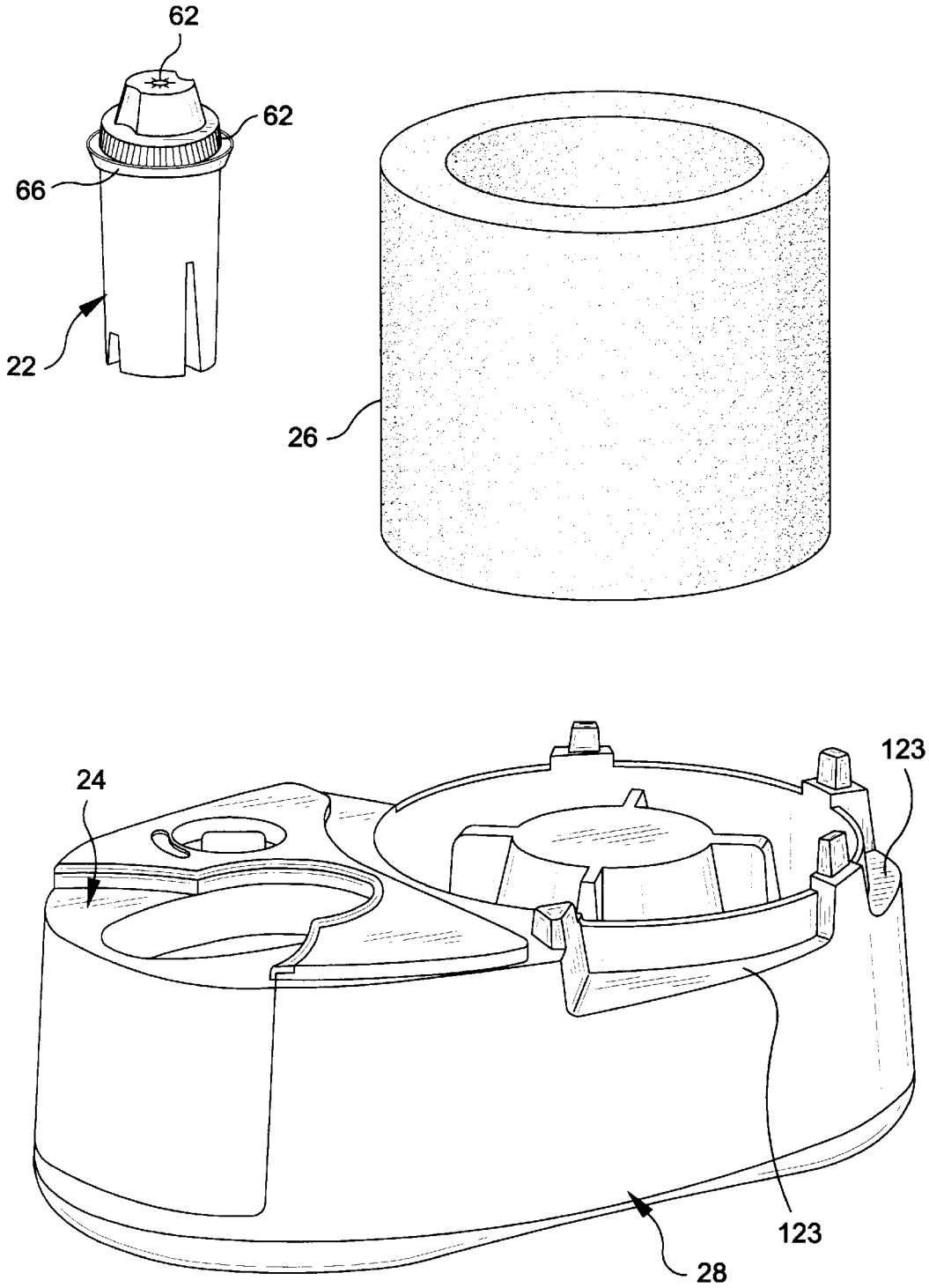
FIG. 1B is an exploded perspective view of the humidifier base of the present invention.
Figure 1C:
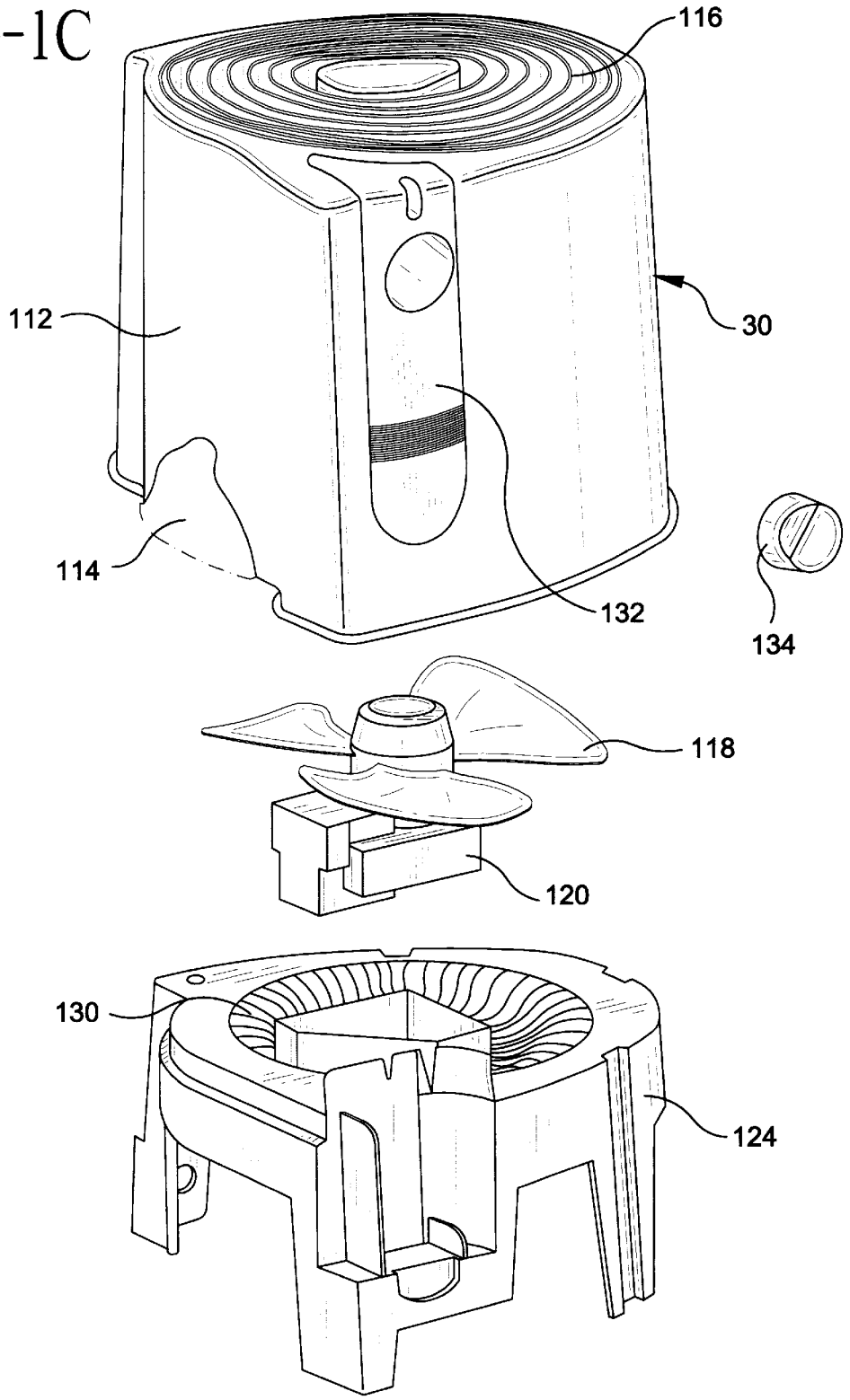
FIG. 1C is an exploded perspective view of the humidification housing of the present invention.
Figure 4:
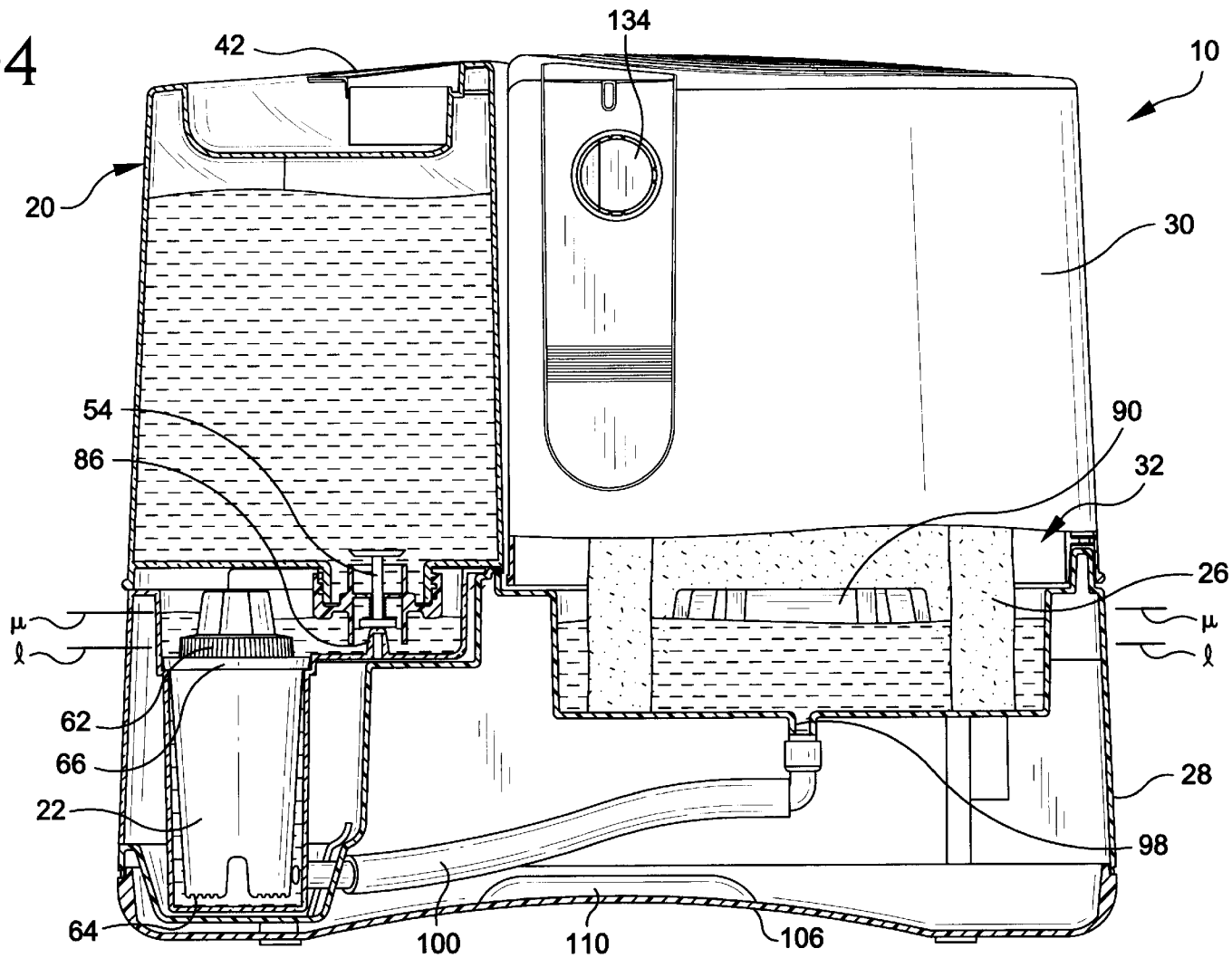
FIG. 4 is a side partial sectional view of the humidifier of the present invention.

Referring to FIGS. 1A–C, humidifier 10 of the present invention includes several main components including tank 20, filter 22, filter holder 24, wick 26, humidifier base 28 and a humidification chamber housing 30 removably securable on humidifier base 28 over wick 26. Humidifier 10 as assembled is shown in FIG. 4.

While the preferred embodiment of the humidifier shown and described herein employs a wick-type evaporative device with filter 22, it is within the contemplation of the present invention that any type of vaporization device such as heating coils, ultrasonic transducers or the like may be used to vaporize the filtered water. In addition, throughout this specification the terms vaporize and vaporization is used to refer to the process of transforming water to a gas-like state such as a vapor or fine spray so that it will be dispersed to the surrounding air and increase the water content thereof.

Tank 20 of humidifier 10 contains the supply water which is transferred to a humidification chamber 32 in which the water is transformed to a vaporized state. Tank 20 is preferably removably supported on base 28 and is sized to hold a relatively large volume of water prior to its being vaporized. The tank is preferably sized to hold a gallon of water, although the tank may be of almost any size depending on the application. Referring specifically to FIG. 1A, tank 20 includes a top wall 34, a bottom wall 36 and a curved side wall 38 extending therebetween forming tank interior 40 in which the supply water is held. Tank 20 may be preferably formed out of a transparent or semi-transparent polymer in order to permit a user of the humidifier to determine how much water remains in the tank. Tank 20 may further include a handle 42 rigidly attached to top wall 34. Top wall 34 may further include an indentation 44, disposed beneath handle 42 in order to permit a space for one's hand to fit in order to facilitate the carrying of tank 20.

Tank 20 may further include a fill hole 46 located on bottom wall 36 thereby providing a passage for water to both enter and exit the tank. The fill hole may include a threaded collar 48 extending outwardly from bottom wall 36. Fill hole 46 may be sealed by a tank cap 50 which threadedly engages collar 48 and seals against an annular gasket 52 set within tank cap 50. In order to permit water to exit the tank in a controlled manner, tank cap 50 may include a valve assembly 54 of a type well known in the art. As shown in FIGS. 1A and 4, valve assembly 54 includes a valve stem 56 slidable supported in tank cap 50, valve seal 58 and spring 60 which urges the valve assembly into a closed position. The valve is movable between a closed position and an open position upon insertion of tank 20 into base 28 in a manner which will be described below.

Water which is introduced into tank 20 upon refilling is typically drawn from the tap and may contain various impurities. Some commonly occurring water borne impurities include sediment, minerals, chlorine and lead. When the water is vaporized through various humidification means, the impurities are carried into the air. The minerals and sediment carried by the water vapor will come to rest on surfaces surrounding the humidifier resulting in what is commonly referred to as "white dust." This typically occurs in ultrasonic vapor producing humidifiers. Minerals in the water may precipitate out and produce scale deposits which form on the components of the humidifier device itself. Scale reduces the humidifiers effectiveness and requires a user to frequently clean the unit. In addition, impurities such as chlorine which can be carried by the vaporized air may be inhaled by individuals, and some authorities indicate that the inhalation of such substances may present health problems. While some of these impurities may be removed by the wick in a wick-type evaporative humidifier, the wick will eventually become contaminated and its operational efficiency will be reduced. Accordingly, it is desirable to remove these impurities from the water prior to its reaching the wick and prior to vaporization.

Figure 2:
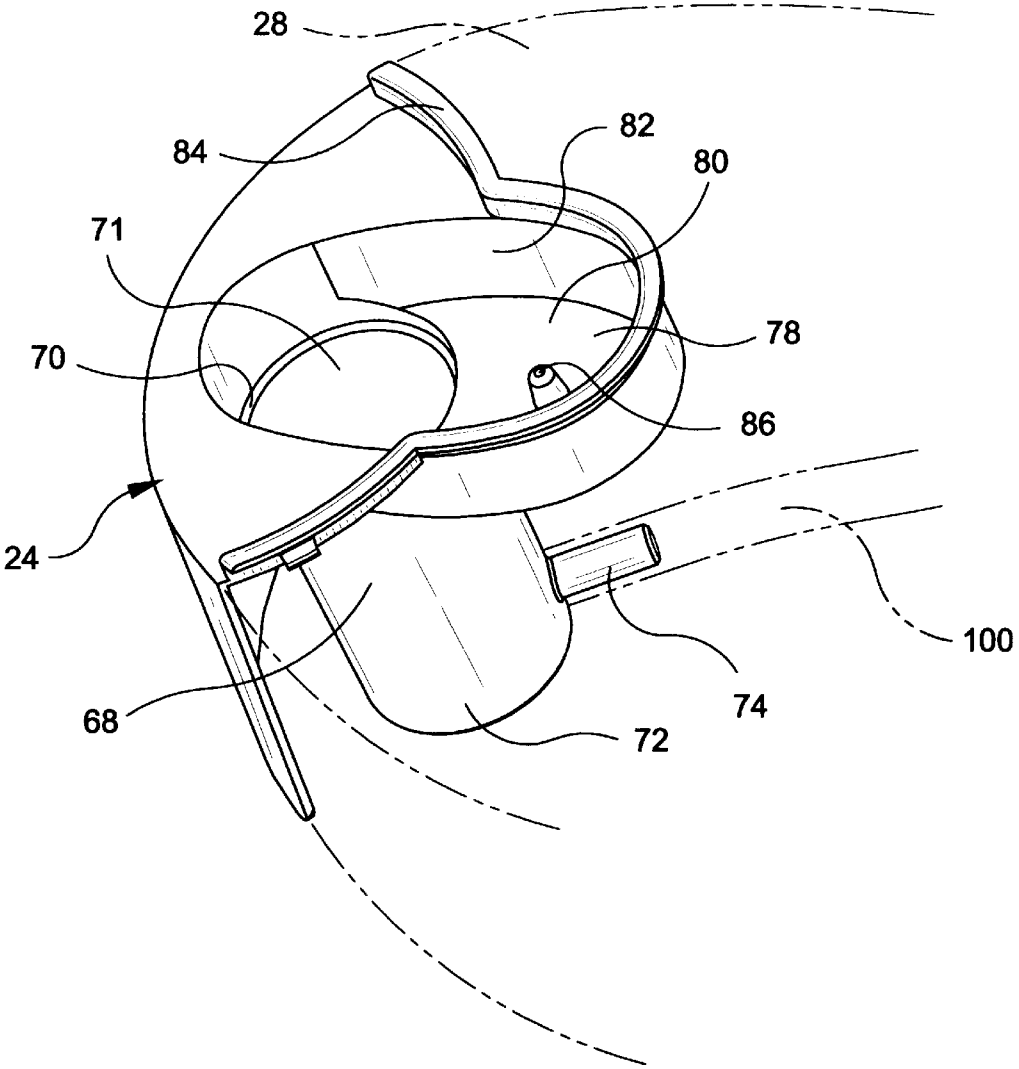
FIG. 2 is a top perspective view of filter housing of FIG. 1B.

In order to remove such impurities, the present invention employs a filter 22. Filter 22 is removably secured in the humidifier by way of a filter holder 24 which is shown in detail in FIG. 2. Filter 22 is preferably a cartridge filter of the type manufactured and made commercially available by Brita Products Company, Model No. OB03, which includes a filter element consisting of an ion exchange resin and silverized activated carbon. Such a filter element is capable of removing 93% of lead ANSI/NSF Standard No. 53 and copper traces and reducing the levels of chlorine from tap water. The filter element also removes particulate in Class V as defined in ANSI/NSF Standard No. 42. The silver component of the silverized activated carbon acts as a bacteriostat which inhibits the growth of bacteria in the filter thereby prolonging the filter's life. The present invention also contemplates the use of other cartridge type filters which remove similar levels of impurities. Filter 22 may also be of the type shown and described in U.S. Pat. No. 4,969,996 or that shown in U.S. Pat. No. 4,666,600 both of which are hereby incorporated by reference.

In an alternative embodiment, the filter may be of a reverse osmosis type filter which filters a significant portion of the impurities from the water. Both the Brita filter and a reverse osmosis type filter, due to their increased filtration abilities, offer significant advantages over the deionizer type filters used in prior art devices which merely soften the water and remove some particulate.

It is also within the contemplation of the present invention for the filter to be of a deionizing type which removes dissolved salts of calcium and magnesium from the water prior to vaporization. Such a filter, while not reducing all types of impurities, would still extend the life of the wick by reducing the amount of water borne impurities which would negatively affect the performance of the wick.

As shown in FIGS. 1B and 4, filter 22 is preferably an elongate frustoconically shaped member having an upper portion including a plurality of inlets 62 and a bottom portion having a plurality of outlets 64. The impurities are filtered out from the water as it flows from inlets 62 through the filter to outlets 64 disposed adjacent the filter bottom. An annular ring 66 extends about filter 22 beneath inlets 62.

Filter 22 is removably held in filter holder 24. Filter holder 24 is preferably secured within base 28 such that it is directly below a portion of tank 20 when the tank is seated on base 28 as shown in FIG. 4. However, in an alternative embodiment, filter holder 60 may be removably insertable in base 90 to aid in replacing filter 22 and cleaning of the device. Filter holder 24 preferably includes an elongate frustoconical filter housing 68 which is sized to receive filter 22. Filter 22 may be placed into filter housing 68 such that inlets 62 face upwardly. Filter housing 68 includes an inwardly extending rim 70 set below an opening 71 which supports filter 22. Filter housing 68 also includes a side wall 72 which contains an aperture therein from which an output tube 74 extends. Tube 74 is in fluid communication with wick 26 in order to provide filtered water thereto.

Figure 3:
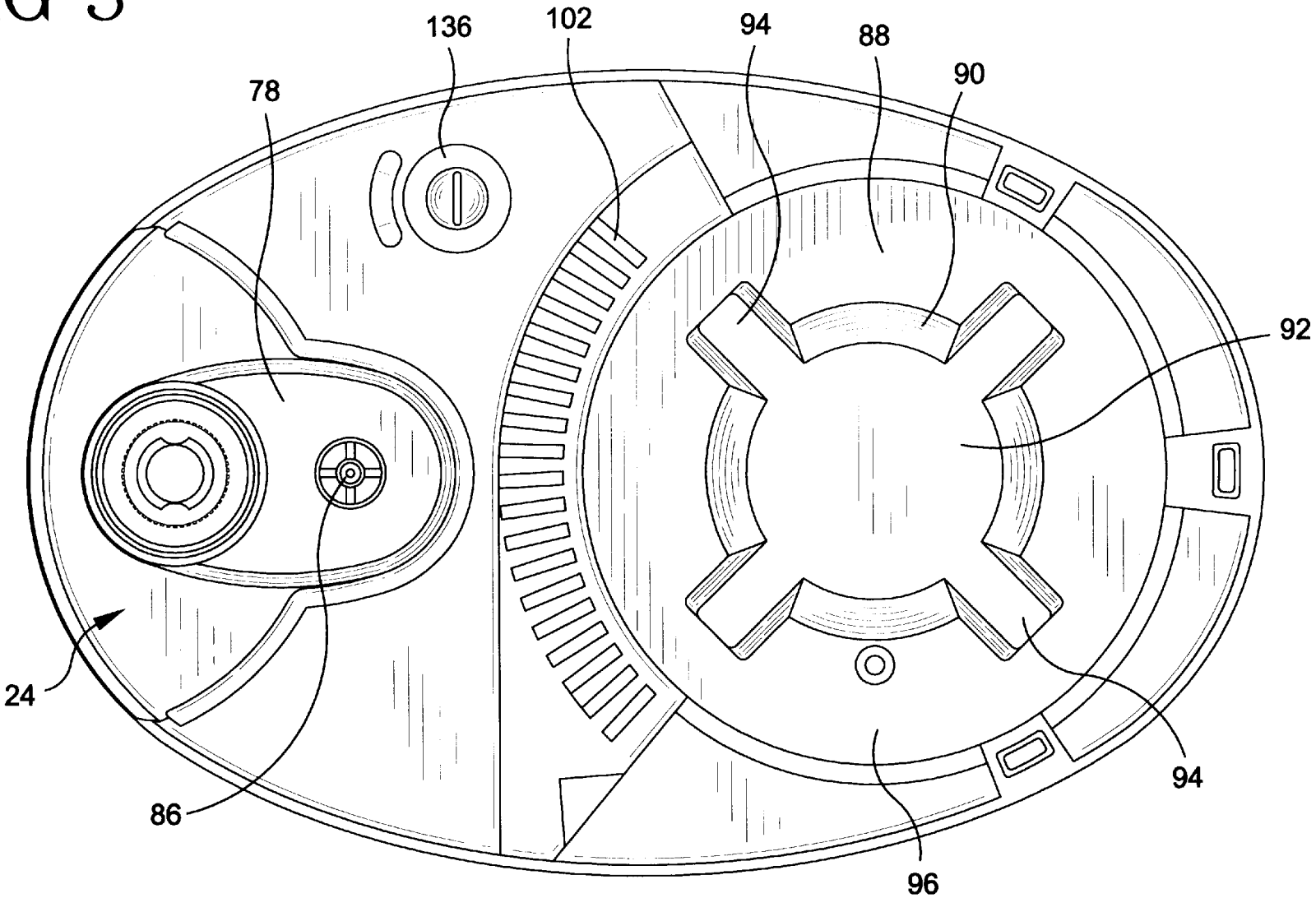
FIG. 3 is a top plan view of the humidifier base of FIG. 1B.

Referring additionally to FIG. 3, the upper portion of filter holder 24 includes an somewhat semicircular reservoir 78 extending substantially perpendicular from filter housing 68. Reservoir 78 includes a base 80 which is perimetrically bounded by an upwardly extending side wall 82 ending in lip 84. Base 80 is coplanar with the opening 71 of filter housing 68 such that water may flow freely from reservoir 78 to filter inlets 62. Filter 22 may further include an annular ring 66 to frictionally engage filter housing 68 adjacent rim 70 thereby forming a seal. This seal prevents unfiltered water from passing around the sides of filter 22, thereby ensuring that all the water is processed by filter 22.

In order to start the flow of water from supply tank 20 into reservoir 78, the present invention includes a valve actuation member 86 which is preferably formed by an elongate member projecting upwardly from reservoir base 80. Valve actuation member 86 is located such that when tank 20 is positioned on humidifier base 28, valve actuation member 86 engages valve stem 56 and urges the valve into an open position thereby permitting air to flow in and water to flow out from tank 20. Prior to passing through filter 22 the water is stored in reservoir 78. When the water in reservoir 78 reaches a level in which water substantially covers the opening into tank 20, air can no longer flow into the tank, therefore, water will stop flowing from tank 20. When the water level in the reservoir drop below a low level mark, the opening into the tank is exposed to air which enters the tank allowing water to exit therefrom. This method of controlling the flow of water from a humidifier tank is well known in the art.

The water held in reservoir 78 flows through filter inlets 62 and passes through the filter elements where the impurities are removed. The water then flows out of the filter through outlets 64 into output tube 74 which is in communication with wick basin 88.

Now referring to FIGS. 1B, 3 and 4, wick 26 is removably supported on base 28 in a wick basin 88. Wick basin 88 is a generally circular-shaped structure including a wick support 90 upwardly projecting from a basin bottom wall 96. Wick support 90 includes a center 92 and a plurality of diametrically opposed support members 94. Support members 94 are designed to frictionally engage the inner wall of wick 26 in order to maintain the wick in proper alignment. Wick 26 is preferably a tubular-shaped device formed of an expanded cellulose material of a type well known in the art. Wick 26 is insertable about wick support 90 such that the lower edge of the wick rests upon bottom wall 96.

A nipple 98 which is shown in FIG. 4, extends from basin bottom wall 96 and provides an opening therein in order to permit the filtered water to be supplied to wick 26 for eventual vaporization. Nipple 98 may be in fluid communication with filter holder output tube 74 via a flexible conduit 100 fitted therebetween. Conduit 100 is preferably a flexible piece of tubing shaped to continuously curve upwardly as it extends from filter holder output tube 74 to nipple 98, in order to permit a continuous flow of filtered water into basin 88. In an alternative embodiment (not shown), a conduit molded in base 28 could provide the fluid connection between filter holder 24 and wick basin 88.

The present invention ensures that the correct amount of water will be supplied to wick basin 88 as long as there is water in supply tank 20. In order for wick 26 to operate efficiently only the bottom portion thereof should be submerged in water. This exposes the maximum amount of wick to the air. Capillary action draws the water up thereby saturating the portion of wick 26 above the water line. The elongate configuration of filter 22, with outlets 64 being disposed on the bottom, along with the desire to produce a humidifier which is compact and portable, requires that filter outlets 64 be positioned vertically below basin bottom wall 96. Accordingly, the humidifier of the present invention provides a means for supplying water to wick basin 88 in spite of its position vertically above filter outlets 64.

To achieve and maintain the proper basin water level, valve assembly 54 located on tank 20 is designed to permit water to flow from tank 20 when the water level falls below a low water line l—l shown in FIG. 4. This low water level is set to be vertically above wick basin bottom wall 96 to ensure that wick 26 will have a steady supply of water. Since wick basin 88 and reservoir 78 are fluidly connected, a hydraulic balance between the two will be achieved, i.e. the water level in reservoir 78 will be equal to the level in basin 88. Therefore, the level of water in basin 88 will not drop below the low water level l—l unless tank 20 has run empty. This will ensure wick 26 has a steady supply of water for vaporization. The maximum basin water level is also maintained by valve assembly 54 which stops of flow of water from tank 20 when a upper water level U—U is reached.

Filtered water which is supplied to wick basin 88, as described above, is absorbed by wick 26 through capillary action such that the entire wick becomes saturated with water. Humidification is achieved in a manner well known in the art by drawing air over the wick such that the air absorbs the moisture and carries it into the surrounding environment. The present invention provides for air to be drawn over substantially the entire surface of wick 26 due to the placement of air channels about the wick's circumference, thereby maximizing the humidifiers efficiency.

Figure 7:
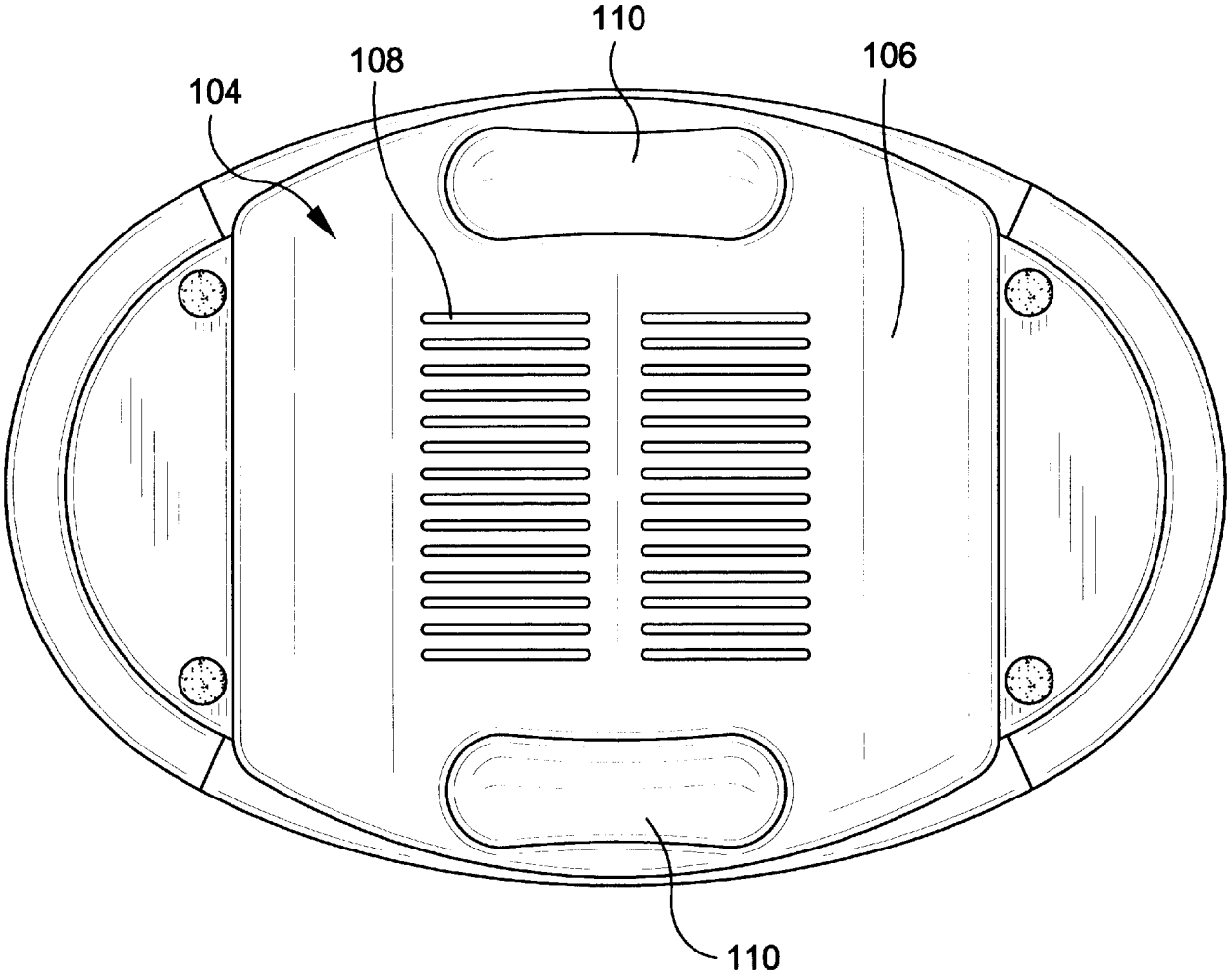
FIG. 7 is a bottom plan view of the base.

Referring to FIG. 3, a plurality of air outlets 102 are formed through base 28 adjacent a portion of the outer wall of wick basin 88 such that they are adjacent to a portion of the circumference of wick 26. Air outlet 102 permit air to flow into humidification chamber 32. Corresponding air inlets 108 are included on a bottom surface 104 of base 28 as shown in FIG. 7. Bottom surface 104 may include a raised center portion 106 such that when humidifier 10 is placed on a flat surface an air space is provided underneath the humidifier which allow air to be drawn into humidifier 10 and through air outlets 102. Raised center portion 106 also permits a user to place their hands under humidifier 10 and engage a pair of spaced handles 110 formed on bottom surface 104. Handles 110 may preferably be formed by a pair of depressions molded in bottom surface 104. Handles 110 allow a user to securely hold humidifier 10 and carry it to a desired location.

As previously discussed, the preferred embodiment includes an evaporative wick-type humidification device. The filtered water is converted to a vapor in a humidification chamber 32 which is defined substantially by humidification chamber housing 30 and wick basin 88. Wick 26 sits within wick basin 88 and is covered by housing 30. Humidification chamber housing 30, shown in FIGS. 1C and 4, includes a side wall 112 which defines a substantially circular interior 114. The top portion of chamber housing 30 may be covered by a grill 116 which allows the humidified air to pass from humidification chamber 32 into the environment. Humidification chamber housing 30 is removably securable on humidifier base 28 such that it may be removed to permit wick 26 to be inspected and replaced as needed.

With reference to FIG. 1C, a fan 118 driven by electric motor 120 is supported within a motor frame 124 all of which are disposed within humidification chamber 32. Motor frame 124, includes a plurality of legs 126 which are supported by an upper surface of the base adjacent wick basin 88. Motor frame 124 includes a centrally disposed motor housing 128 to which the fan and motor is secured. Motor frame 124 is designed to be placed on top of wick 26, and therefore, includes a plurality of radially spaced slots 130 which allow air which has been drawn over wick 26 to pass through. Humidification chamber housing 30 may be placed over and secured to motor frame 124. Accordingly, chamber housing 30, motor frame 124, and fan 118 may all be removed as one unit from base 28.

Figure 8:
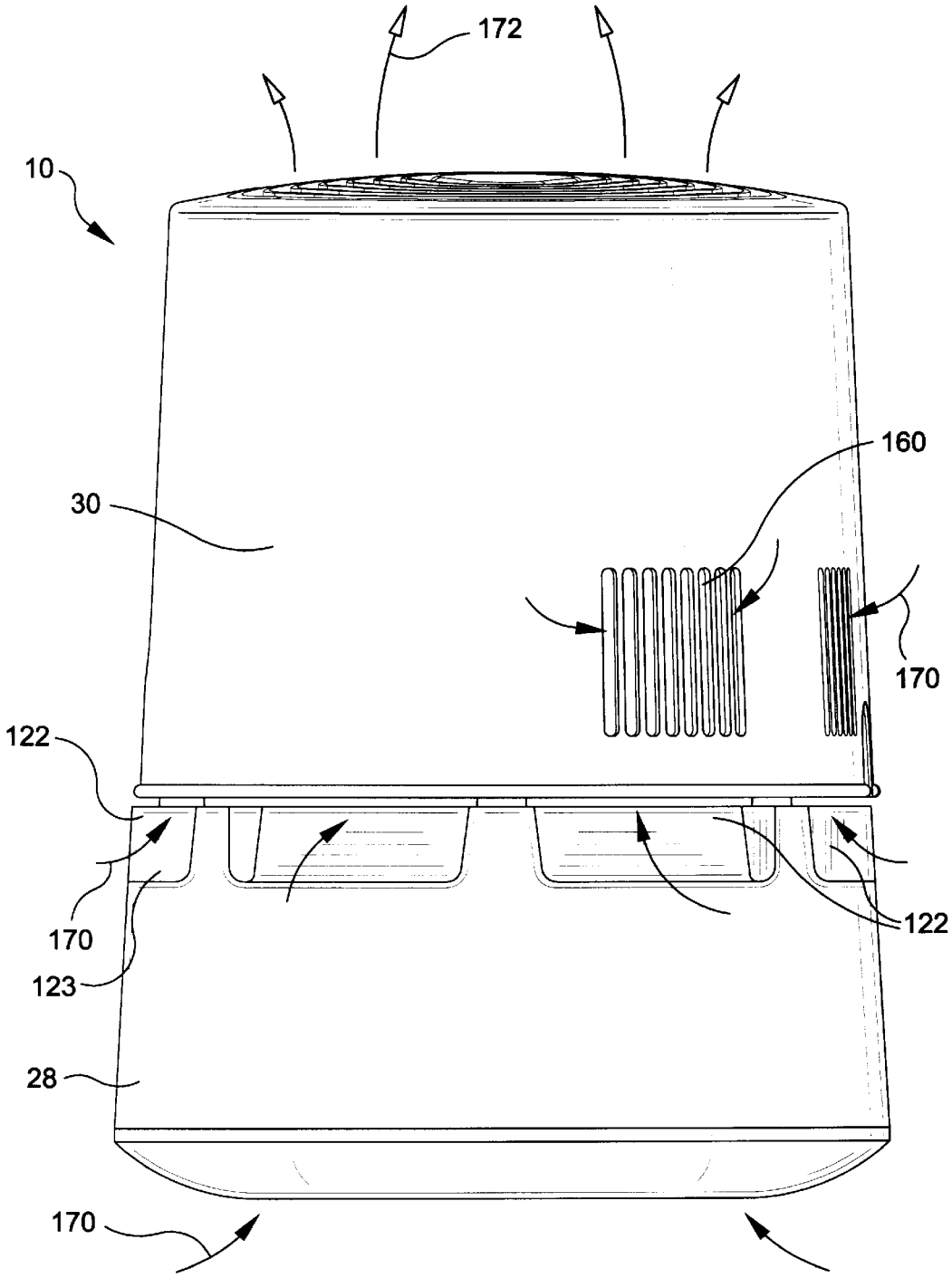
FIG. 8 is a side elevational view of the humidifier of the present invention.

In order to increase the volume of air drawn over wick 26, humidifier 10 may include a plurality of side slots 122, as shown in FIG. 8. Side slots 122 are formed between base 28 and humidification chamber housing 30. Side slots 122 preferably extend about the circumference of wick 26 so that, in combination with air chambers 102, substantially the entire diameter of wick 26 is exposed to the air. Side slots 122 are preferably formed by molding a series of steps 123 in base 28 so that a gap exists between chamber housing 30 and base 28. In addition, humidification chamber housing 30 may also include openings 160 to increase the flow of air over wick 26.

The air is drawn by the operation of fan 118 into humidification chamber 32 and over wick 26 through air inlets 108 on bottom surface 104 and through air outlets 102 located adjacent wick 26, through side slots 122 and openings 160. Therefore, substantially the entire circumference of wick 26 is exposed to circulating air.

As shown in FIG. 1C, humidification chamber housing 30 may also support a control panel 132 which contains controls 134 for adjusting the speed of the fan thereby allowing a user to control the rate of humidification. A humidistat may also be operatively integrated with the control circuitry such that a desired level of humidification may be maintained in a manner known to one skilled in the art.

Base 28 may also include a device for advising a user that filter 22 should be changed and replaced with a new one. Water filtering devices typically have a service life tied to the amount of water that has been processed. Therefore, in order to ensure that a filter will operate at an acceptable level of efficiency, manufactures typically specify a water volume amount which may be processed after which the filter should be changed.

Figure 5:
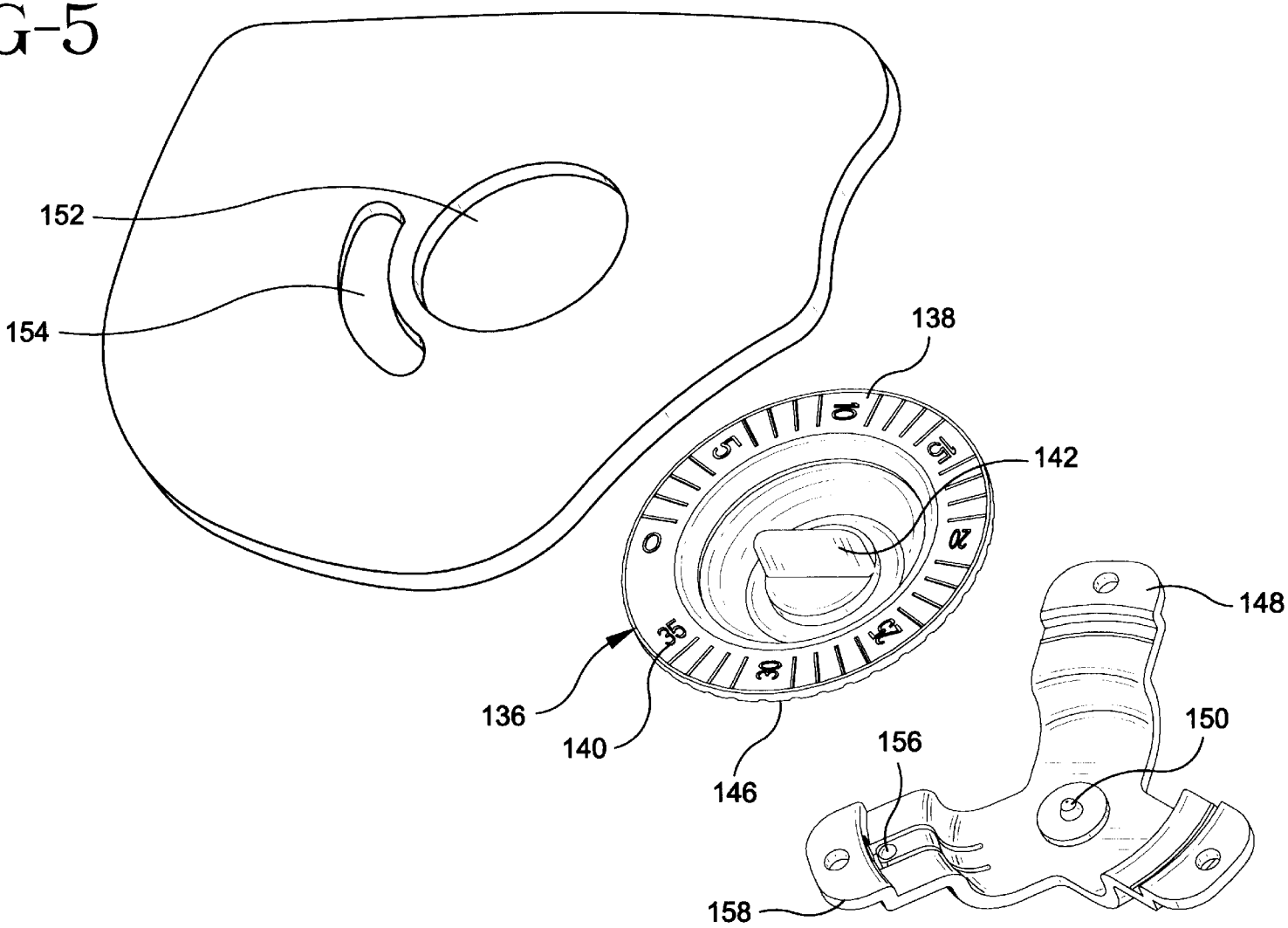
FIG. 5 is an exploded perspective view of the dial indicator assembly of the present invention.
Figure 6:
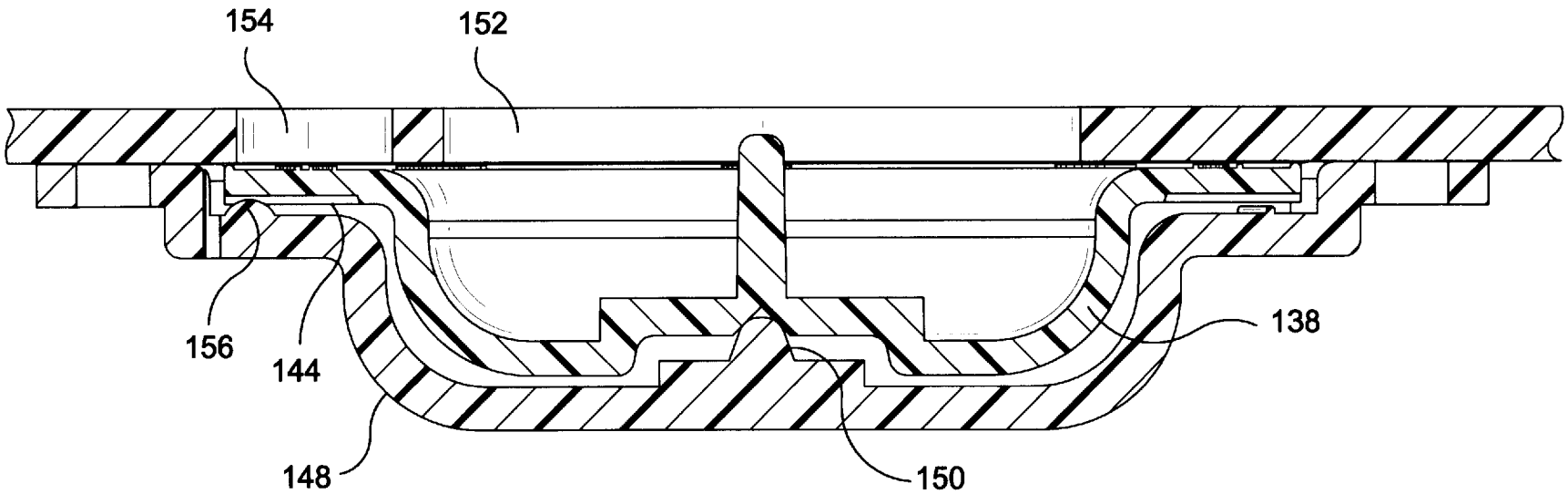
FIG. 6 is a side cross-sectional view of the dial indicator assembly secured to the base taken through a centerline of the dial.

In the preferred embodiment, the indication device includes a counter having a dial indicator 136, as shown in FIGS. 3, 5 and 6. The dial may be advanced by a user each time tank 20 is filled. Since a tank holds a fixed volume of water, a manufacturer can recommend changing filter 22 after a certain amount of tank fulls have been processed. Dial 136 includes a top surface 138 on which there is a plurality of radially spaced indica 140 which include numbers. A knob 142 may be disposed in the center of dial 136 in order to permit the dial to be rotated by a user. Dial 136 includes a bottom surface 144 having a plurality of annularly spaced protrusions 146. A bracket 148 may be employed to rotatably support the dial in base 28. Bracket 148 has a centrally disposed pin 150 upon which dial 136 is rotatably supported.

The indexing function of the dial may be achieved by including a projection 156 formed on one of the arms 158 of bracket 148, as shown in FIGS. 5 and 6. Projection 156 is sized to fit between spaced protrusions 146. As dial 136 is rotated, protrusions 146 ride over projection 156 which moves in and out of the slots formed between protrusions 146 creating discrete dial positions.

Humidifier base 28 includes an aperture 152 formed therein, as shown in FIG. 6, to permit placement of dial 136 and access thereto. An annularly slotted window 154 may be formed in base 28 adjacent aperture 152 through which the indicia 140 may be read by the operator of humidifier 10. Aperture 152 and window 154 are preferably located on base 28 such that they are covered when tank 20 is in place, yet visible and accessible when the tank is removed from base 28. This reduces the likelihood of an individual tampering with dial 136 and generating false readings.

Dial indicator 136 may be rotatably indexed by an operator a certain portion each time tank 20 is refilled. The indica 140 may be sequential numbered such that each time the tank is refilled, a user may index the dial and thereby keep track of the number of tank fills which have been processed by a particular filter. Accordingly, when the maximum number is reached, the user will be aware that it is time to change filter 22. For example in the preferred embodiment, the manufacturer recommends that the Brita filter be changed after processing 35 gallons of water. In the preferred embodiment, tank 20 holds one gallon. Therefore, for such a configuration, when the number 35 is reached on the dial the words "Change Filter" will appear in window 154 to alert the operator that the filter should be changed.

In an alternative embodiment (not shown) dial indicator 136 may include a mechanism for advancing the dial each time the tank is removed and then replaced. In addition, the indexing counter may be of the type having axially aligned rotating cylinders having annularly spaced numbers of the type well known in the art.

The operation of humidifier 10 will now be described. Tank 20 may be filled with water through fill hole 46 after which tank cap 50 may be tightly secured by the user to prevent water from leaking from the tank. Filter 22 may then be inserted into filter holder 24. If a fresh filter is being used, the user may rotate dial indicator 136 to the appropriate starting point such as zero (0), thereby initializing the counter feature. Tank 20 may then be fitted onto base 28. When so doing, valve actuation member 86, extending from the base wall 80 of the filter holder, engages valve stem 56 thereby allowing water to flow into reservoir 78. Water in reservoir 78 then flows into filter inlets 62 located at the upper portion of filter 22 and begins to seep through the filter leaving various impurities behind. Filtered water then exits filter outlets 64 and flows from output tube 74 through conduit 100 into wick basin 88. The filtered water is then drawn up through wick 26 by capillary action resulting in saturation of the wick.

Non-humidified air 170 is forced over wick 26 by way of fan 118. The air is drawn in to the humidification chamber through a variety of openings including base bottom surface inlets 108, air channels 102, and through side slots 130 as shown in FIG. 8. The multitude of passageways results in a relatively high volume of air being brought into contact with wick 22. The air is then drawn over and about wick 22 humidified and expelled from humidification chamber 32 through grill 116 into the surrounding environment as humidified air 172. This results in humidification of the surrounding environment by water vapor which has been treated by filter 22. As water is vaporized, the water level in basin 88 is kept substantially constant by the flow resulting in the pressure differential cause by any change in water level between basin 88 and reservoir 78.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope and spirit of the invention.

What is claimed is:

1. A humidifier for vaporizing water comprising:

a base;

a wick formed of a water absorbing material positionable on said base;

a water supply in fluid communication with said wick;

a device for moving air over said wick disposed adjacent thereto to vaporize the water absorbed by said wick thereby humidifying the air about the humidifier; and a filtration device disposed in the flow of the water to said wick, said filtration device being capable of removing impurities from the water supplied to said wick such that said wick is not contaminated by the impurities.

2. A humidifier as defined in claim 1 wherein said water supply comprises a refillable tank for holding water positioned on said base, and a control device for providing a controlled flow of the water from said tank to said wick.

3. A humidifier as defined in claim 1, wherein said filtration device removes dissolved minerals from said water in order to prevent the minerals from contaminating said wick upon vaporization of said water therefrom.

4. A humidifier as defined in claim 3, wherein said filtration device removes magnesium compounds from said water prior to vaporization thereof.

5. A humidifier as defined in claim 3, wherein said filtration device removes calcium compounds from said water prior to vaporization thereof.

6. A humidifier as defined in claim 1, wherein said filtration device removes a substantial amount of contaminants selected from the group consisting of chlorine and lead from said water prior to vaporization thereof.

7. A humidifier as defined in claim 1, wherein said device for moving the air over said wick includes a fan.

8. A humidifier as defined in claim 7, further including a housing enclosing said wick, and wherein said fan is secured within said housing adjacent said wick, said housing including a plurality of openings formed therein to permit humidified air to exit therefrom.

9. A humidifier as defined in claim 8, wherein said housing is removably securable to said base, and said base and said housing defining a plurality of first air intake slots formed between said base and said housing, said first intake slots provide a first set of passage ways for air to be drawn into said housing and over said wick.

10. A humidifier as defined in claim 9, wherein said base includes a bottom portion having a plurality of second slots formed therein providing a second set of passage ways for air to be drawn into said housing and over said wick.

11. A humidifier as defined in claim 1, wherein said base includes a bottom portion having a pair of spaced depressions formed therein forming a pair of handles which may be used for grasping and carrying the humidifier.

12. A humidifier as defined in claim 1, wherein said filtration device includes an ion exchange resin and silverized activated carbon.

13. A humidifier as defined in claim 2, wherein said filtration device is removably secured in said base, and said base includes an indicating device for indicating when said filtration device should be changed.

14. A humidifier as defined in claim 13, wherein said indicating device includes a counter for tracking a number of tank fulls of water processed by said filtration device.

15. A humidifier as defined in claim 14, wherein said counter includes a rotatable dial having indicia thereon being indexable by a humidifier operator to indicate the number of tank fulls which has been processed by said filtration device.

16. A humidifier for vaporizing water comprising:

a refillable tank for holding a supply of water;

a humidification device for vaporizing the water thereby humidifying the air about the humidifier, said humidification device including a wick which is formed of a water absorbing material, and a device for moving air over said wick to vaporize the filtered water from said wick;

a valve disposed between said tank and said humidification device for providing a controlled flow of the water from said tank to said humidification device; and a filter disposed in the flow of water between said tank and said humidification device, said filter reducing an amount of chlorine from the water prior to vaporization thereof, such that the vaporized water will be substantially free of chlorine.

17. A humidifier as defined in claim 16 wherein said filter includes an ion exchange resin and silverized activated carbon.

18. A humidifier for vaporizing water and humidifying air comprising:

a tank for holding a water supply;

a base unit having a reservoir being in fluid communication with said water supply tank, said reservoir having a bottom portion including an orifice through which water may flow;

a humidification device disposed on said base for vaporizing the water to humidify the air;

a control valve for regulating the flow of the water from said tank into said reservoir, said valve permitting the water to flow from said tank into said reservoir when a water level in said reservoir drops below a low water level condition;

said base further including a basin for holding water prior to vaporization thereof, said basin having a bottom wall; and a conduit for fluidly connecting said orifice to said basin, said basin bottom wall being disposed vertically above said orifice and vertically below said low water level such that said basin will have a controlled supply of water supplied by said tank.

19. A humidifier as defined in claim 18 further including an elongate generally conically-shaped filter, said filter dividing said reservoir into an upper and lower chamber, said upper chamber adapted for containing pre-filtered water and said lower chamber adapted for containing filtered water which has passed through said filter, said lower chamber having a bottom portion including said orifice through which the filtered water may pass to said basin.

20. A humidifier as defined in claim 19 wherein said filter includes an element for removing minerals and chlorine from said supply of water.

21. A humidifier as defined in claim 20 wherein said filter element includes and ion exchange resin and silverized activated carbon.

22. A humidifier as defined in claim 19 wherein said conduit includes a flexible tube.

23. A humidifier as defined in claim 18 wherein said humidification device includes a wick composed of water absorbing material, said wick being disposed in said basin for contact with the filtered water contained therein.

24. A humidifier as defined in claim 18 wherein said humidification device includes an ultrasonic transducer disposed adjacent to said basin in fluid contact with the filtered water contained therein.

25. A humidifier as defined in claim 18 wherein said humidification device includes a heat generating device disposed adjacent to said basin and in fluid contact with the water contained therein.

26. A humidifier as defined in claim 18 wherein said base includes an indicating device for indicating when said filter should be changed.

27. A humidifier as defined in claim 26 wherein said indicating device includes a counter for tracking the number of tank fulls of water which has been processed by the filter.

28. A method of humidifying air comprising the steps of:

providing a humidification device for vaporizing water including a wick;

providing a filter;

supplying water to said filter;

filtering said water thereby reducing the impurities therein;

transporting said filtered water to said wick; and evaporating said filtered water from said wick thereby humidifying the surrounding air.

* * * * *